US005695352A

United States Patent [19]

Abe

[11] Patent Number: 5,695,352

[45] Date of Patent: Dec. 9, 1997

[54] FEMALE TERMINAL FITTING

[75] Inventor: Yukiyasu Abe, Yokkaichi, Japan

[73] Assignee: Sumitomo Wiring Systems, Ltd., Japan

[21] Appl. No.: 520,075

[22] Filed: Aug. 28, 1995

[30] Foreign Application Priority Data

Sep. 9, 1994 [JP] Japan ..... 6-242036

[51] Int. Cl.[6] ..... H01R 27/00

[52] U.S. Cl. ..... 439/223; 439/850; 439/852

[58] Field of Search ..... 439/218, 222, 439/223, 224, 850, 851, 852, 857

[56] References Cited

U.S. PATENT DOCUMENTS

| | | | |
|---|---|---|---|
| 3,023,392 | 2/1962 | Lamaudiere | 439/223 |
| 3,192,498 | 6/1965 | Ruehlemann | 439/223 |
| 3,842,391 | 10/1974 | Dechelette | 439/223 |

FOREIGN PATENT DOCUMENTS

| | | | |
|---|---|---|---|
| 573 825 | 12/1993 | European Pat. Off. . | |
| 60-211786 | 10/1985 | Japan . | |
| 1-60471 | 4/1989 | Japan . | |
| 937602 | 7/1962 | United Kingdom . | |
| 1001210 | 8/1965 | United Kingdom | 439/223 |

*Primary Examiner*—Neil Abrams
*Assistant Examiner*—Barry Matthew L. Standig
*Attorney, Agent, or Firm*—Banner & Witcoff, Ltd.

[57] ABSTRACT

A female electrical terminal has clamping segments 13 with contact faces 15A for tab-type terminals and contact faces 14A for pin-type terminals. A receiving segment 16 has a tab-type terminal contact face 15B and pin-type terminal contact faces 14B. The space between the tab-type terminal contact faces 15A and 15B forms a tab-type terminal insertion slot 17. The space enclosed by the pin-type terminal contact faces 14A, 14A, 14B forms a pin-type terminal insertion slot 19. Various configurations are disclosed.

10 Claims, 7 Drawing Sheets

FIG. 6
PRIOR ART
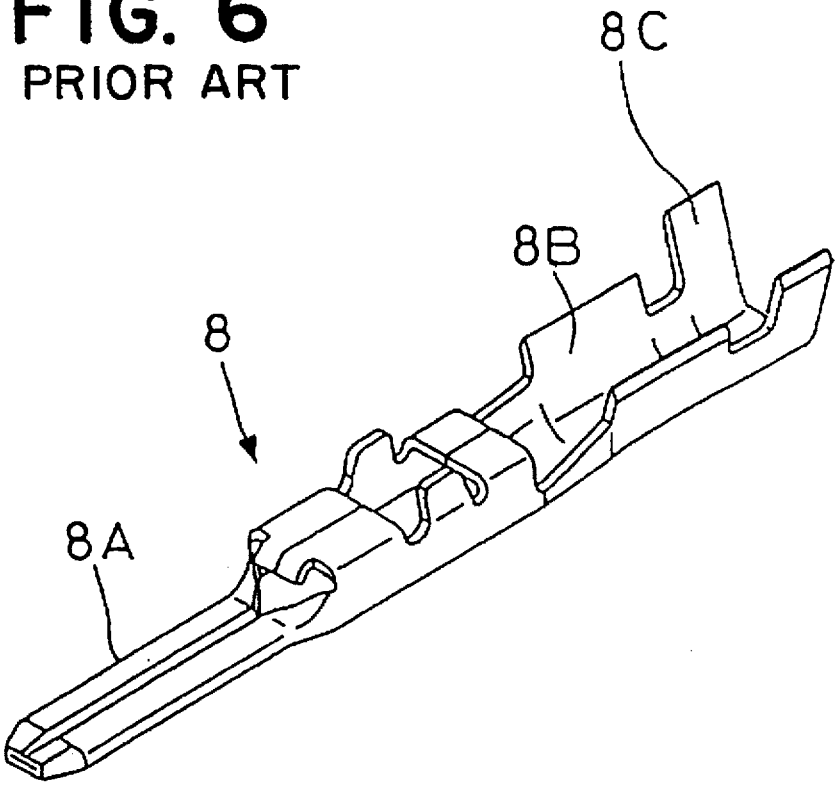
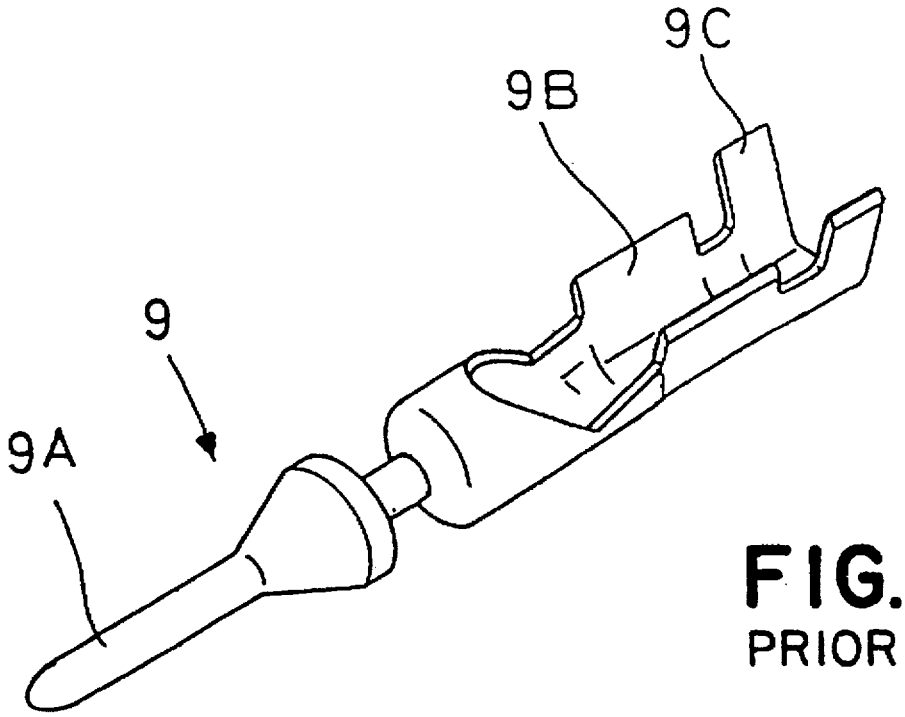
FIG. 7
PRIOR ART

FEMALE TERMINAL FITTING

TECHNICAL FIELD

The present invention relates to a female terminal adapted to establish electrical contact by having a male terminal inserted therein.

BACKGROUND OF THE INVENTION

For making contact in electrical connectors, two representative types of male terminal are the flat tab-type and the cylindrical pin-type.

FIG. 6 of this specification shows a typical tab-type male terminal formed by bending and shaping a thin metal plate. Its rear end has sleeve portions 8B and 8C formed thereon into which electrical wires (not shown) are crimped: and its front comprises a double thickness projecting tab 8A.

FIG. 15, of this specification illustrates a conventional female terminal 100 corresponding to this tab-type terminal 8 and which is also formed by bending and shaping a thin metal plate. Its rear end has sleeve portions 101 and 102 formed thereon into which electrical wires (not shown) are crimped; and its front comprises has a box member 103 whose extreme end is open. A resilient contact segment 104 is double-folded and extends into the box member 103 from the lower side (as viewed). An insertion slot 105 adapted to receive the tab 8A is formed between the contact segment 104 and the top side of the box member 103. When the tab 8A is inserted into the slot 105, the upper and lower faces of the tab 8A come into contact respectively with the top side of box member 103 and the contact segment 104. As a result, a specified amount of contact pressure is maintained due to the restoring force of the contact segment 104, and electrical continuity is established between the male terminal 8 and the female terminal 100.

FIG. 7 thereof shows a pin-type male terminal 9 formed from a linear metallic material. At the front end it has an elongated, thin insertion pin 9A that is circular when seen in cross-section, and at the rear sleeves 9B and 9C are provided into which electrical wires (not shown) are crimped. As shown in FIG. 16 hereof, a female terminal 110 made from a metallic material and corresponding to the pin-type terminal 9 has an insertion tube 111 fixed at the extreme front end whose interior portion comprises a circular insertion slot 112. The rear end of the female terminal 110 has sleeves 113 and 114 into which electrical wires (not shown) are crimped. A resilient contact member (not shown) is formed on the inner circumference of the insertion tube 111 and projects inward slightly. When the insertion pin 9A of the pin-type terminal 9 is inserted into the insertion slot 112, the resilient contact member, by virtue of its inherent restoring force, applies a specified contact pressure on and makes contact with the outer circumference of the insertion pin 9A, thereby establishing electrical continuity between the male terminal 9 and the female terminal 110.

The above-mentioned prior art female terminals 100 and 110 are designed to have the most appropriate shape and length so as to exclusively accept the tab type terminal 8 and the pin-type terminal 9 respectively. Consequently, even if the length of the insertion pin 9A of the pin-type terminal 9 were such as to allow its insertion into the female tab type terminal 100 problems would occur, such as the difficulty of maintaining the rounded insertion pin 9A stable, the difficulty of achieving the specified contact pressure, etc. Furthermore, it is clearly impossible to insert the male tab-type terminal 8 into the female pin-type terminal 110 due to the difference in shape.

Thus, hitherto, even when standards regarding the electrical current values etc. are the same, different female terminals have to be used depending on the shape of the male terminals required. As a consequence, production and management costs etc. are increased and operating efficiency is low.

The invention described in this specification has been developed after taking into consideration the problems discussed above and aims at providing a female terminal that can be used both with tab-type and pin-type male terminals.

SUMMARY OF THE INVENTION

According to the invention there is provided a female electrical connector for receiving a male connector of the tab-type or of the pin-type, the connector having inwardly directed resilient contact members defining at least one aperture and, adapted to receive a tab-type male connector or a pin-type male connector, the contact members being adapted to contact a tab-type male connector on both flat sides thereof and a pin-type male connector at three points around the circumference thereof.

Such a female connector is adapted to receive either kind of male connector. The tab of a tab-type terminal can be received within the terminal insertion slot of the female terminal fitting, and the tab-type terminal contact faces make contact with and grip the tab. As a result, the tab-type male terminal is stably supported and electrical connectivity between the female terminal fitting and the tab-type terminal is obtained.

Further, the insertion pin of the pin-type terminal can be received within the terminal insertion slot of the female terminal fitting, and the pin-type terminal contact faces make contact with the pin so as to contact it at at least three points. As a result, the pin-type terminal is stably supported and electrical connectivity with the pin-type terminal is obtained.

In one preferred embodiment two contact members are provided. Preferably three contact members are provided, of which two contact members may be adapted to contact a tab-type male connector and two contact members may be adapted to contact a pin-type male connector.

In preferred embodiments two of the contact members are a handed pair and thus define mirror-image elements of the connector. The handed pair of contact members are preferably disposed substantially opposite a third contact member.

In preferred embodiments all of the contact members may be adapted to contact both a tab-type and a pin-type male connector.

BRIEF DESCRIPTION OF THE DRAWINGS

Other features of the invention will be apparent from the following description of preferred embodiments shown by way of example only in the accompanying drawings in which:

FIG. 6 is a isometric view of a prior art tab-type terminal;

FIG. 7 is an isometric view of a prior art pin-type terminal;

DETAILED DESCRIPTION OF THE PREFERRED EMBODIMENTS

The first embodiment of the present invention is described hereinbelow, with reference to FIGS. 1 to 7.

A female terminal 1 of the present invention is formed from a thin electrically conductive metal plate. Its rear portion has a wire sleeve 1A into which electrical wires (not shown) are crimped, and an insulation sleeve 1B. The front portion consists of a thin, elongated insertion member 10 which extends longitudinally and into which a male terminal is inserted.

Figure 1:
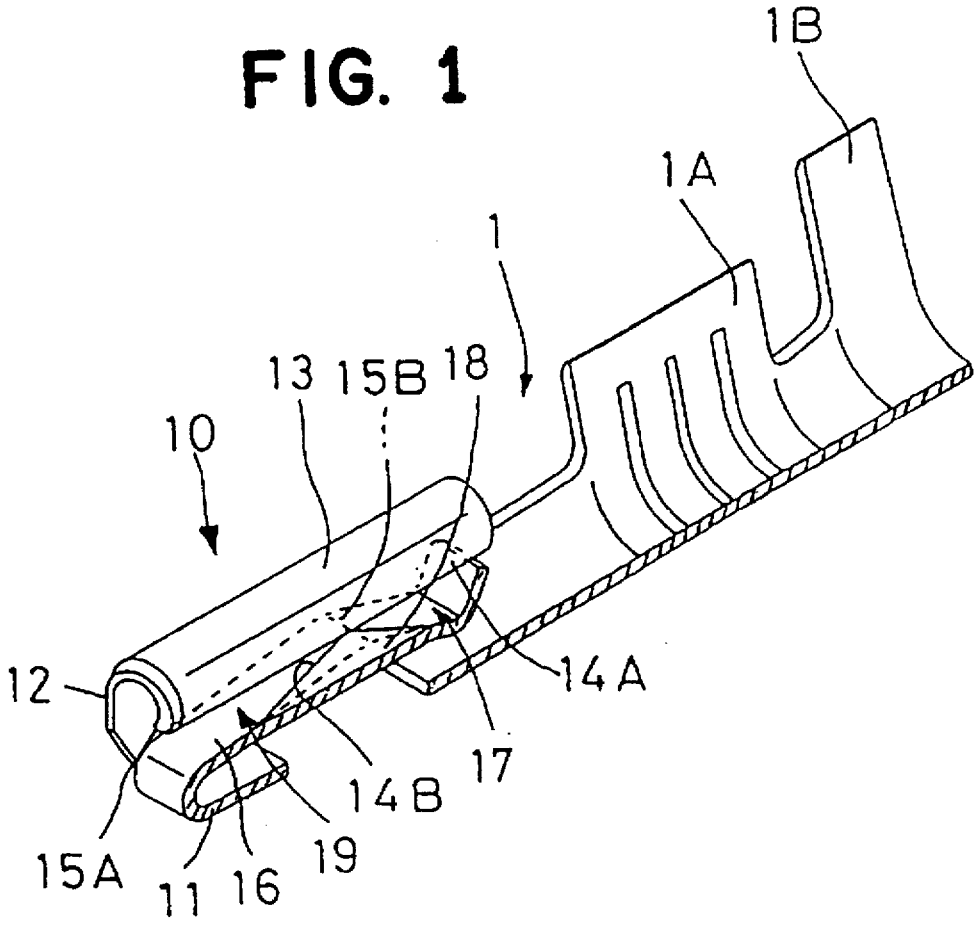
FIG. 1 is a partially cut-away isometric view of a female terminal constituting the first embodiment of the present invention.
Figure 2:
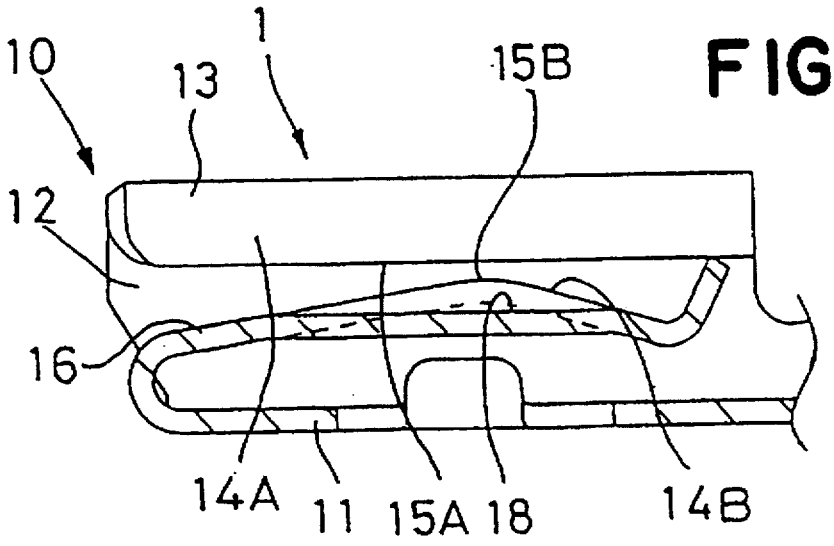
FIG. 2 is a vertical cross-section showing the front portion of the female terminal of FIG. 1.
Figure 3:
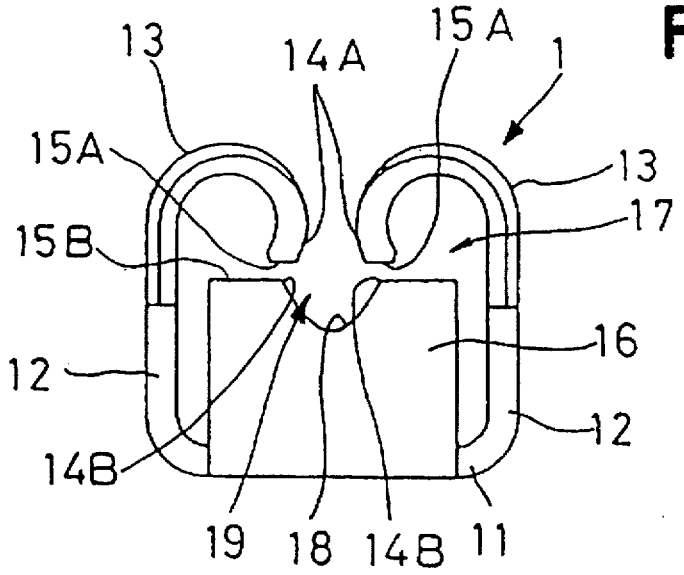
FIG. 3 is a front elevation showing the state preceding the insertion of a male terminal.
Figure 4:
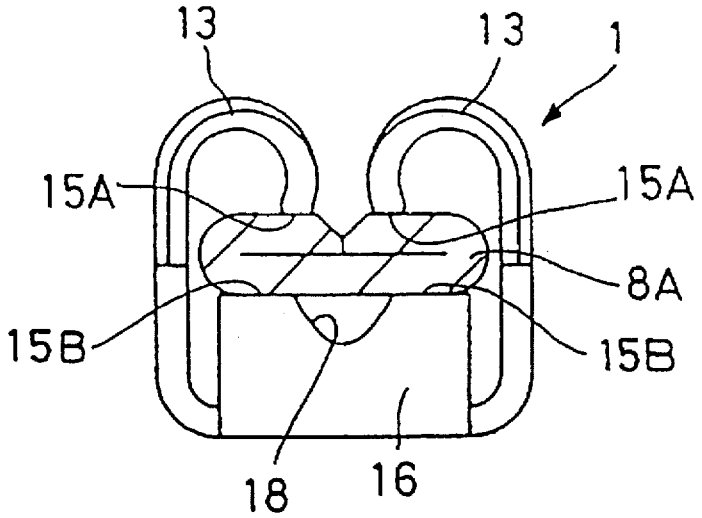
FIG. 4 is a front elevation showing the state following the insertion of a tab-type terminal.
Figure 5:
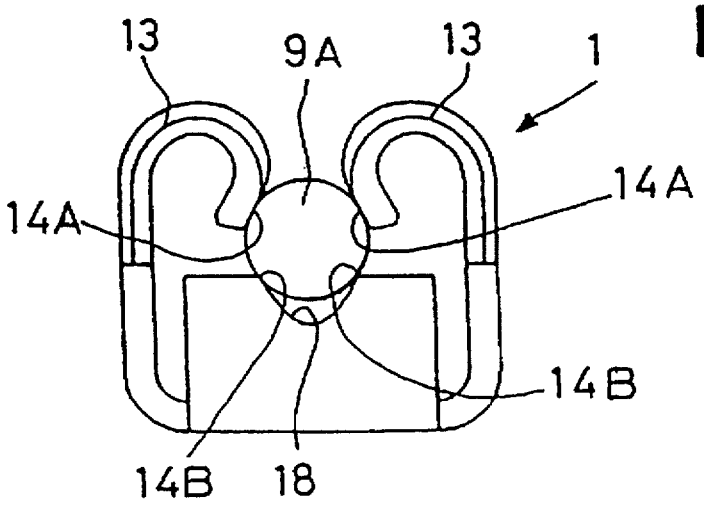
FIG. 5 is a front elevation showing the state following the insertion of a pin-type terminal.

The insertion member 10 has side walls 12 which rise upwards from the left and right sides of the bottom wall 11 (as viewed). A pair of resilient clamping segments 13 curve inwardly from the upper ends of the side walls 12. The clamping segments 13 curve to form an approximate semicircle from the upper ends of the side walls 12 and, upon reaching a perpendicularly oriented point, extend diagonally in a downward and outward direction. Cross-sectionally, each has an unvarying shape along its entire longitudinal length. The adjacent faces of the diagonal portions comprise contact faces 14A for a pin-type terminal (FIG. 3). The extreme ends of the diagonal portions are approximately perpendicular to the side walls and from contact faces 15A for a tab type terminal (FIG. 4). The clamping segments 13 comprise a handed pair, that is to say segments of generally identical form but provided as left and right handed elements about an axis of symmetry.

A resilient receiving segment 16 is provided continuously along the extreme front end of the bottom wall 11. This receiving segment 16 is bent over and extends downwards and backwards from the tab-type terminal contact faces 15A. The receiving segment 16 has a gentle slope whose peak constitutes a tab-type terminal contact face which faces, and is separated by a specified distance from the contact faces 15A. The separation distance is slightly less than the thickness of the tab of a tab-type terminal 8 (FIG. 6). The tab-type terminal contact faces 15A, 15B and the side walls 12 form a tab-type terminal insertion slot 17.

Around the vicinity of the highest (innermost) portion of the receiving segment 16, an insertion groove 18 is formed longitudinally over a specified distance by forming the segment 18 into a concave shape. The left and right extremities of the insertion groove 18 form pin-type terminal contact faces 14B in opposition to contact faces 14A. This pin-type contact face 14B makes linear contact along the entire length of the insertion pin of a pin-type terminal 9 (FIG. 7).

Regarding the relative positions of the pin-type terminal contact faces 14A and 14B, the external diameter of an imaginary circle that touches the four contact faces 14A, 14B is arranged to be less than the external diameter of the corresponding pin 9A of the pin-type terminal 9. The space defined by these contact faces 14A, 14B forms a pin-type terminal insertion slot 19 which has a portion common with the tab-type terminal insertion slot 17

Consequently, the female terminal of the present embodiment can be connected with the commercially available male tab-type terminal (FIG. 6) and with the commercially available male pin-type terminal (FIG. 7).

The operation of this first embodiment is now described.

When a male tab-type terminal 8 is to be connected the tab 8A is inserted into the insertion slot 17, and the tab 8A slides along the upper face of the resilient receiving segment 16 so as not to abut the ends of the clamping segments 13. As the insertion progresses, the upper and lower faces of the tab 8A respectively come into contact with the contact faces 15A of the clamping segments 13 and the contact faces 15B of the receiving segment 16. Due to the thickness of the tab 8A, the clamping segments 13 undergo resilient deformation as the respective contact face 15A moves upward and, simultaneously, the receiving segment 16 undergoes resilient deformation in the downward direction. The resilient forces clamp the tab 8A from above and below. Accordingly, the tab-type terminal 8 is supported in a specified position making electrical contact with a specified contact pressure.

When the pin-type terminal 9 is to be connected, the insertion pin 9A is inserted into the insertion slot 19, and the insertion pin 9A slides along the upper face of the resilient receiving segment 16 so as not to abut the extreme ends of the clamping segments 13. As the insertion progresses, the external surface of the pin 9A comes into contact with the contact faces 14A of the clamping segments 13, and the contact faces 14B of the receiving segment 16 at four circumferential points equidistantly located. The clamping segments 13 and receiving segment 16 undergo resilient deformation as previously described. Accordingly, the pin-type terminal 9 is supported in a specified position, and the contact faces 14A, 14B make electrical contact with a specified contact pressure.

Since the female terminal fitting 1 of the present embodiment allows the insertion of both the tab-type and the pin-type male terminals it is superior to all those female terminals which are specially designed for the one or the other type of male terminal from the point of view of production, management and other costs, operating efficiency, etc.

Moreover, unlike female terminals in which support members are located in different positions, the female terminal 1 of the present embodiment can be miniaturized since the pair consisting of the clamping segments 13 and the receiving segment 16 support both the tab-type terminal and the pin-type terminal 19.

Figure 8:
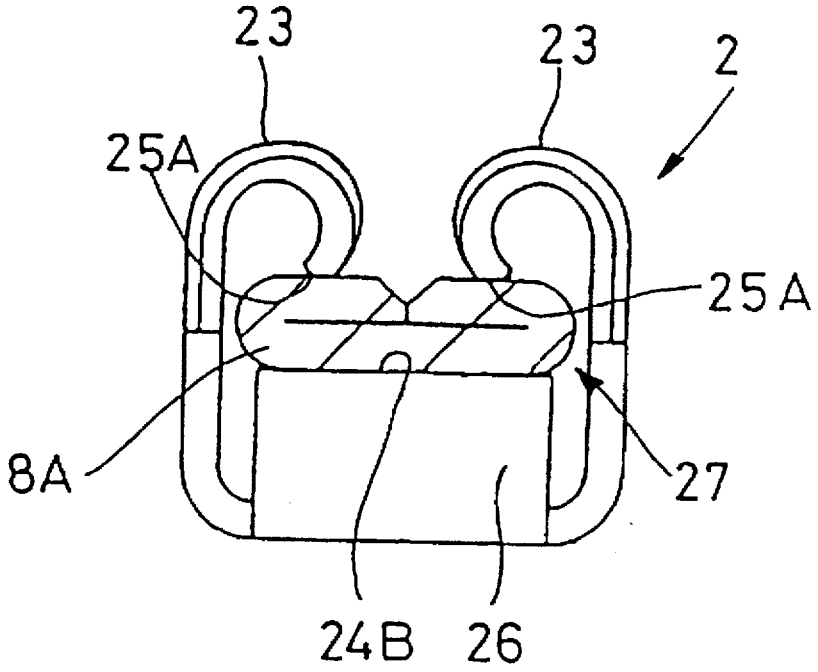
FIG. 8 is a front elevation showing the state following the insertion of a tab-type terminal into a female terminal according to a second embodiment of the invention.
Figure 9:
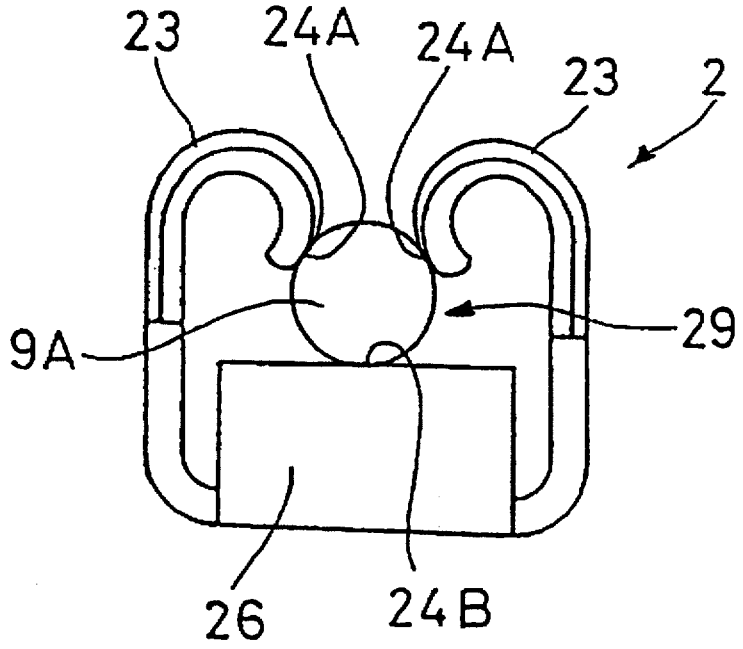
FIG. 9 is a front elevation showing the state following the insertion of a pin-type terminal into the female terminal of the second embodiment.

The second embodiment of the present invention is described with reference to FIGS. 8 and 9.

The resilient clamping segments 23 of the present embodiment have a shape that differs slightly from that of the first embodiment, but the terminal has approximately the same configuration in all other respects; the clamping segments 23 also comprise a handed pair.

A resilient receiving segment 26 does not have anything corresponding to the insertion groove 16 provided in the first embodiment, nor the pin-type terminal contact faces 14B. However, the segment 26 has a contact face 24B which is common to both the tab-type terminal and the pin-type terminal and which is formed in a width direction on a centrally located portion of the peak formed by the receiving segment 26. The space between tab-type terminal contact faces 25A, 25A of the clamping segments 23, and the common contact face 24B is less than the thickness of the tab of a tab-type terminal as in the case of the first embodiment.

Since an insertion groove is not provided in the receiving segment 26, the position of a pin during insertion is rather higher (as viewed). However, the distance between pin-type contact faces 24A is greater than the space between the corresponding contact faces 14A of the first embodiment. Accordingly, this difference in the height of the insertion pin 9A is accommodated.

When a pin-type terminal is to be connected into the present embodiment, the insertion pin is inserted into the slot 29 and the two contact faces 24A, make contact from a diagonally upward direction; the common contact face 24B makes contact from below. The pin-type terminal 9 is thus supported in a stable configuration from three sides by the contact faces 24A and 24B.

The insertion of the tab-type terminal 8 is carried out in the same way as in the case of the first embodiment. The tab inserted into the slot 27 is clamped from above and below by the contact faces 25A and the common contact face 24B.

Figure 10:
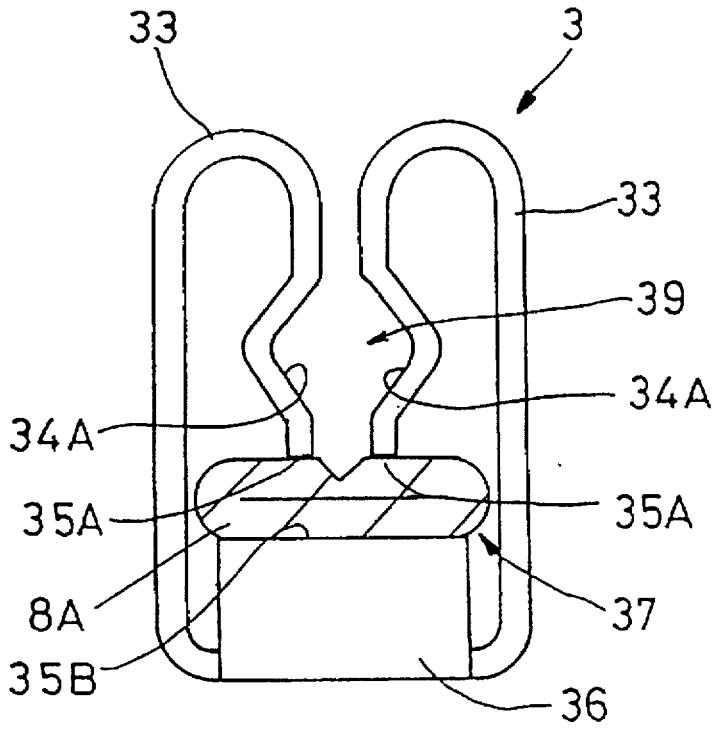
FIG. 10 is a front elevation showing the state following the insertion of a tab-type terminal into a female terminal according to a third embodiment of the invention.
Figure 11:
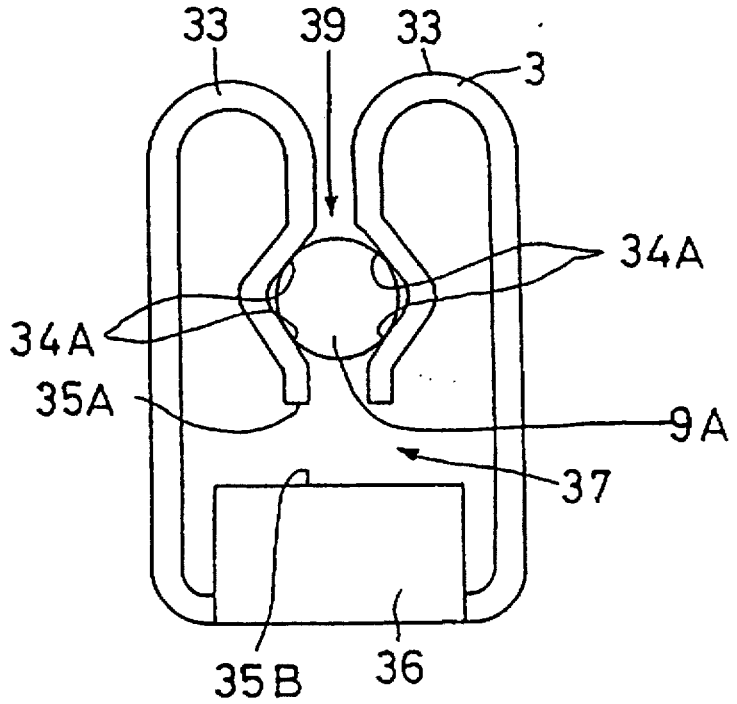
FIG. 11 is a front elevation showing the state following the insertion of a pin-type terminal into the female terminal of the third embodiment.

The third embodiment of the present invention is described with reference to FIGS. 10 and 11.

The clamping segments of the third embodiment have a shape that differs from that of the second embodiment. A somewhat triangular bend is formed in the downwardly extending portion of each clamping segment so as to project outward. The space enclosed by this bent portion forms a pin-type insertion slot 39. The internal side faces of the bent portion form pin-type terminal contact faces 34A, which surround and make contact with the pin in four places. The extreme end of each clamping segment 33 faces down and forms a tab-type terminal contact face 35A. The space between the tab-type contact faces 35A and 35B forms a tab-type insertion slot 37 that is different from the pin-type terminal insertion slot 39. The segments 33 again comprise a handed pair.

When a pin-type terminal 9 is inserted the contact faces 34A make Contact from four sides-and the pin-type terminal is clamped from the left and the right sides due to the resilient restoring force, and is supported firmly in place. When a tab-type terminal is inserted, the contact faces 35A and 35B clamp from above and below, and thereby make contact with the tab and support it firmly in place.

Figure 12:
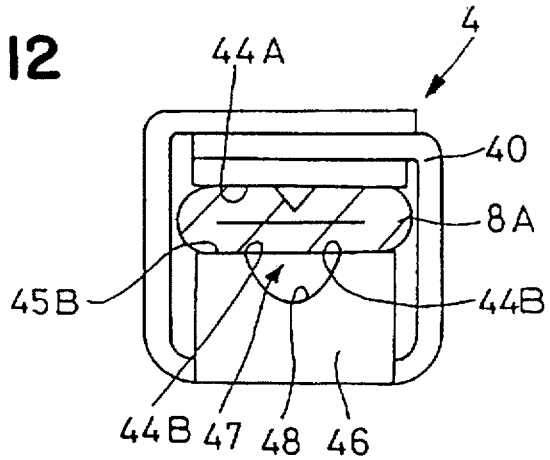
FIG. 12 is a front elevation showing the state following the insertion of a tab-type terminal into a female terminal according to a fourth embodiment of the invention.
Figure 13:
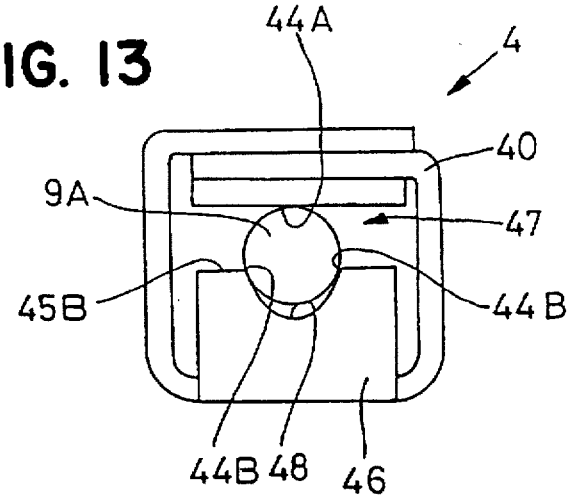
FIG. 13 is a front view showing the state following the insertion of a pin-type terminal into the female terminal fitting of the fourth embodiment.
Figure 14:
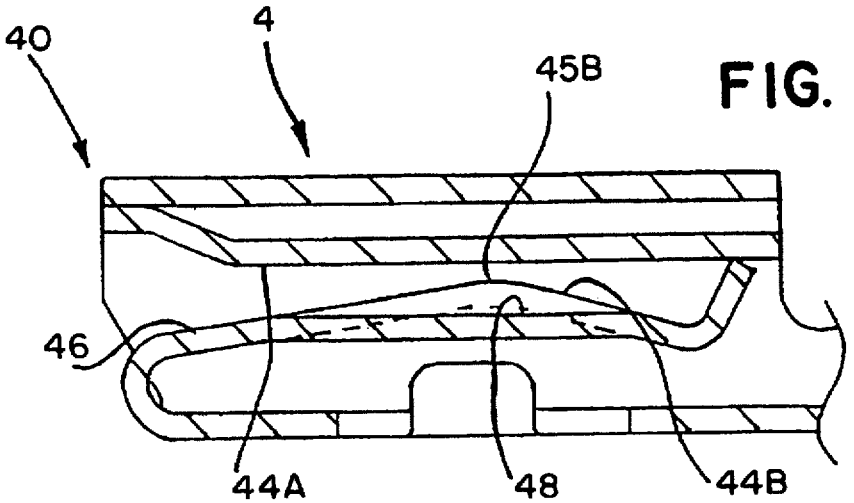
FIG. 14 is a vertical cross-section showing the front portion of the terminal of FIGS. 12 and 13.
Figure 15:
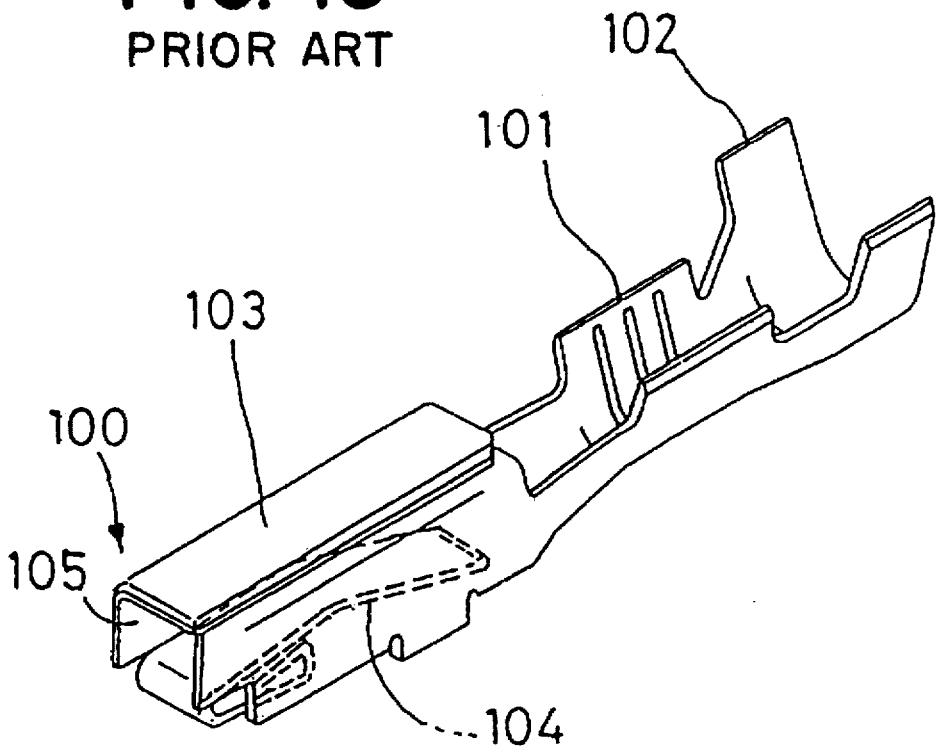
FIG. 15 PRIOR ART
FIG. 15 is an isometric view of a prior art female terminal fitting for tab-type terminals.
Figure 16:
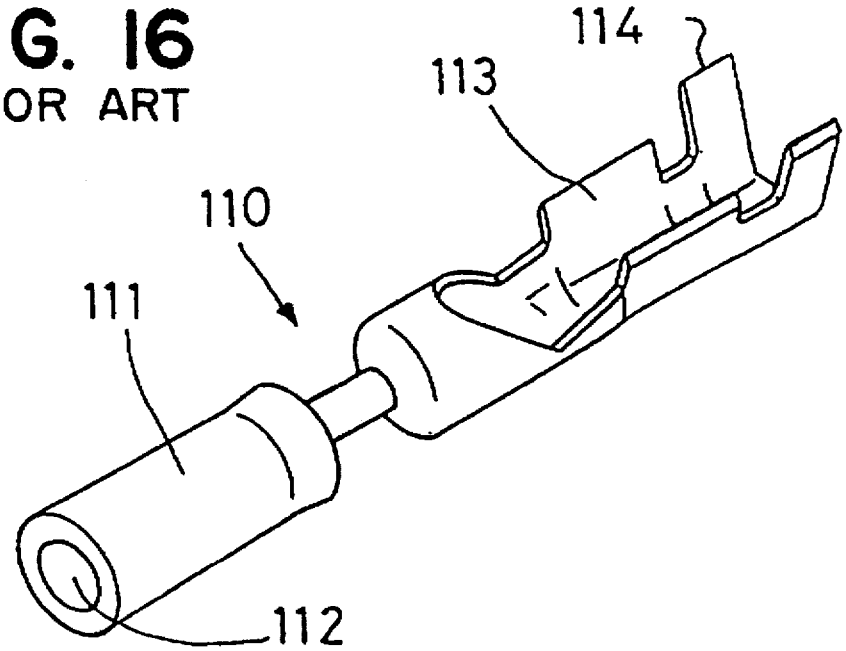
FIG. 16 PRIOR ART
FIG. 16 is an isometric view of a prior art female terminal fitting for pin-type terminals.

The fourth embodiment of the present invention described with reference to FIGS. 12–14.

The female terminal of the fourth embodiment has a box-shaped insertion portion 40 whose end face is open. A resilient receiving segment 46 is folded from the extreme end of the insertion potion 40 into the interior thereof, and extends towards the rear. The space between the top (as viewed) of the insertion portion 40 and the receiving segment 46 forms a common insertion slot 47 for a tab-type terminal and a pin-type terminal. The top face of the insertion portion 40 extends downwards and the lower face of this extended portion forms a common contact face 44A. The upper face of the receiving segment 46 forms a tab-type terminal contact face 45B. A downwardly concave insertion groove 48 is formed in the receiving segment 46 and the edges of the left and right sides thereof form pin-type terminal contact faces 44B.

When the tab-type terminal is to be connected to the terminal of this embodiment, the tab is inserted into the common insertion slot 47. The tab is clamped from above and below by the common contact face 44A and the tab-type contact face 45B. The tab-type terminal is accordingly supported firmly in place by the resilient restoring force of the receiving segment 46. When the pin-type terminal 9 is to be connected, the insertion pin is inserted into the common insertion slot 47 and makes contact with the common contact face 44A and the pin-type terminal contact faces 44B. The pin-type terminal is accordingly supported firmly in place by the resilient restoring force of the receiving segment 46.

The present invention is not limited to the embodiments described above, and may be embodied in various ways deviating from the scope of the claims appended hereto.

In the first and second embodiments, the pin-type terminal contact faces 14A and 24A are flat surfaces. However, according to the present invention, the pin-type terminal contact faces can be arcuate in shape so that the insertion pin makes contact over a large area thereof.

Although in the third embodiment the bent portion of each pin-type terminal contact face 34A is triangular in shape, the pin-type terminal contact face can be arcuate in shape so as to allow the outer circumference of the insertion pin to fit snugly therein.

Furthermore in the first and fourth embodiments the insertion pin 9A is arranged to make linear contact with the pin-type contact faces 14B, 44B formed in the sides of the insertion grooves 18 and 48: the insertion grooves can be made larger so that the insertion pin makes-contact in the circumferential direction with the inner circumferential face thereof.

Although in the first and fourth embodiments the pin-type terminal contact faces 14B and 44B of the insertion grooves 18 and 48 are sharp, they can alternatively be made arcuate.

I claim:

1. A female electrical connector for receiving a male connector having a tab end or a pin end, the connector having three contact members defining at least one aperture and adapted to receive a tab end male connector or a pin end male connector, the contact members being adapted to contact a tab end male connector on both flat sides thereof and a pin end male connector at three points around the circumference thereof, wherein two of the contact members comprise arcuate resilient arms having free ends directed towards the third one of the contact members, said resilient arms each having a respective first portion extending away from the third one of the contact members and a respective second portion curving inwardly of the connector to said free ends.

2. The female connector of claim 1 wherein two of said contact members are a handed pair, and disposed substantially opposite the third of the contact members.

3. The female connector of claim 1 wherein said free ends comprise electrical contacts.

4. The female connector of claim 1 wherein said free ends comprise electrical contacts.

5. The female connector of claim 1 wherein all of said contact members are adapted to contact a tab end connector.

6. The female connector of claim 1 wherein all of said contact members are adapted to contact said a pin end connector.

7. The female connector of claim 1 wherein one contact member defines a groove adapted for co-operation with a pin end connector, the groove defining two contact points.

8. The female connector of claim 1 and formed from a sheet metal blank.

9. The female connector of claim 2 wherein one contact member defines a groove adapted for co-operation with a pin end connector, the groove defining two contact points.

10. The female connector of claim 9 wherein said one contact member forms the third one of the contact members.

* * * * *